United States Patent [19]

Kitta

[11] Patent Number: 4,918,869

[45] Date of Patent: Apr. 24, 1990

[54] METHOD FOR LAPPING A WAFER MATERIAL AND AN APPARATUS THEREFOR

[75] Inventor: Satoru Kitta, Nagano, Japan

[73] Assignee: Fujikoshi Machinery Corporation, Nagano, Japan

[21] Appl. No.: 262,952

[22] Filed: Oct. 26, 1988

[30] Foreign Application Priority Data

Oct. 28, 1987 [JP] Japan ..... 62-272658

[51] Int. Cl.[5] ..... B24B 5/00

[52] U.S. Cl. ..... 51/131.1; 51/131.3; 51/131.4

[58] Field of Search ..... 51/131.1, 131.3, 131.4, 51/141

[56] References Cited

FOREIGN PATENT DOCUMENTS 63-52967 3/1988 Japan ..... 51/131.4

1364449 1/1988 U.S.S.R. ..... 51/131.4

*Primary Examiner*—Judy Hartman

*Assistant Examiner*—Maurina Rachuba

*Attorney, Agent, or Firm*—McAulay Fisher Nissen & Goldberg

[57] ABSTRACT

In an apparatus for lapping a wafer material, e.g., a semiconductor silicon wafer, by bonding the wafer to the lower surface of a pressing plate, mounting the pressing plate on a turn table to bring the wafer into contact with the turn table and pressing the pressing plate downwardly with a downwardly opening cup-like top ring mounted thereon, the pressing plate is pressed down not directly with the top ring alone but pressed through a rubber membrane covering the downward opening of the top ring and pressurized with compressed air under pressure regulation so that the lapping pressure on the wafer surface can be very uniform and the thus lapped wafer is excellent in respect of the flatness of each lapped surface and parallelism between lapped surfaces.

1 Claim, 8 Drawing Sheets

METHOD FOR LAPPING A WAFER MATERIAL AND AN APPARATUS THEREFOR

BACKGROUND OF THE INVENTION

The present invention relates to a method for lapping a wafer material and an apparatus therefor. More particularly, the invention relates to an improvement in the method for lapping a wafer material, such as semiconductor silicon wafers and glass plates, with outstandingly high precision in the flatness or planarity of the lapped surface and parallelism of lapped surfaces as well as an apparatus therefor.

Needless to say, various wafer materials, such as single crystal semiconductor silicon wafers, are required to have high planarity of the surface and parallelism between surfaces so that the wafers prepared by slicing a single crystal of silicon as grown must be lapped on the surfaces to be imparted with desired planarity and parallelism. The lapping process of wafers is conventionally performed by using a lapping machine, for example, schematically illustrated in FIG. 1. As is shown in the figure, a wafer W is bonded to a pressing plate 1 by using a mounting material or a wax and the pressing plate 1 bearing a wafer W bonded thereto is placed face-down on a horizontally rotating turn table 3 covered with a buffing cloth 2 so as to have the wafer W contacted with the buffing cloth 2 on the turn table 3. A downwardly opening cup-like top ring 8 is mounted on the pressing plate 1 in such a manner that the periphery of the top ring 8 is in contact with the marginal zone of the pressing plate 1. A weight or weights 4 are mounted on the top ring 8 so that the load of the weights 4 is transmitted to the wafer material W via the top ring 8 and the pressing plate 1. As the turn table 3 is rotated, an aqueous dispersion of a fine abrasive powder 7 is supplied on the turn table 3 from the nozzle 6 to be spread over the buffing cloth 2 so that the lower surface of the wafer W is lapped by the sliding movement relative to the turn table 3 covered with the buffing cloth 2 wet with the abrasive dispersion 7.

FIG. 2 schematically illustrates another lapping machine in which a rotatable top ring 8 provided with inlet and outlet channels of cooling water is mounted on the pressing plate 1, which bears a plural number of wafers W bonded to the lower surface thereof with a rubber-made seal ring 9 interposed therebetween and cooling water is passed through the water-tightly sealed space surrounded by the lower surface of the top ring 8 and the upper surface of the pressing plate 1.

One of the problems in the above described conventional lapping machines is that, since the pressing plate 1 is downwardly pressed by the top ring 8 as is illustrated in FIGS. 1 and 2 only at the marginal zone on the upper surface thereof, the pressing plate 1 is more or less warped to be high at the center as is illustrated in FIGS. 3 and 4 so that the amount of the wafer material removed off from surface of the wafer W by lapping is unavoidably larger in the portions near to the outer periphery of the pressing plate 1 than in the portions toward the center of the pressing plate 1 to cause a decrease in the parallelism between the lapped surfaces.

This problem is particularly serious in recent years with the progress of semiconductor technology toward a higher and higher density of integration in semiconductor-based electronic devices in which a very high degree of parallelism between surfaces of a wafer material as well as flatness of the surface are essential. This problems is accordingly a bottleneck to bar the progress of the semiconductor technology so that is is eagerly desired to develop a method and a lapping machine in which the pressing plate is freed from the problem of warping to ensure high accuracy and precision in lapping of wafer materials.

In view of the above described problem, a proposal has been made in Japanese Patent Kokai 57-194874 according to which the pressing plate 1 in FIG. 1 is unevenly loaded in such a manner that the load on the center of the pressing plate 1 is larger than on the marginal zone thereof. The principle of this improvement is that the pressing plate, which is pivotally supported through a connecting body in a freely swayable and rotatable manner, is provided with a steel ball and a socket in the form of a semispherical cavity to receive the steel ball and the load is transmitted to the connecting body from the pivotal axis through the steel ball. This method or apparatus, however, does not provide a complete solution of the problem due to the concentrated loading on the center portion of the pressing plate.

It would also be a possible way in the lapping machine illustrated in FIG. 2 that the upper surface of the pressing plate 1 is deeply cooled by passing chilled water at a low temperature so as to compensate the upward warping by the thermal contraction of the upper surface of the pressing plate 1 and to keep the flatness of the plate 1. This method, however, is not practicable because a satisfactory flatness of the pressing plate 1 can be ensured only by very carefully controlling a number of parameters including the weight of the top ring 8, number and size of the wafers W, temperature and flow rate of cooling water and so on.

A method is known in the prior art (see Japanese Utility Model Kokai 62-165849), in a process for lapping a wafer material bonded to the lower surface of a rotatable pressing plate by mounting the pressing plate on a horizontally rotating turn table so as to bring the surface of the wafer material into contact with the surface of the turn table and downwardly pressing the pressing plate against the turn table to effect lapping of the surface of the wafer material by the relative sliding movement with the surface of the turn table, the pressing plate is pressed down by interposing a flat bag made of an elastic material and filled with air interposed between the top ring and the pressing plate. The effect of such a bag-interposing method is, however, not quite reliable.

SUMMARY OF THE INVENTION

The present invention accordingly has an object to provide a simple but very reliable apparatus freed from the above described problems in the prior art methods and apparatus-es in the lapping works of wafer materials.

The apparatus of the present invention for lapping a wafer material comprises:

(a) a turn table horizontally rotatable around a vertical axis;

(b) a pressing plate, to the lower surface of which at least one wafer material is bonded, and mounted on the turn table tp bring the surface of the wafer material into contact with the turn table;

(c) a top ring in the form of a downwardly opening cup, the opening thereof being covered by spreading a membrane of an elastic material, e.g., rubber, fluid-tightly sealed to the periphery of the cup, rotatable around a vertical axis and mounted on the pressing plate to be in contact therewith by the membrane of an elastic material;

(d) a means to supply a pressurized fluid to the space on the inner surface of the membrane of an elastic material; and (e) a means to regulate the pressure of the pressurized fluid.

DETAILED DESCRIPTION OF THE PREFERRED EMBODIMENTS

As is described above, the very scope of the invention consists in the improvement in which the pressing plate, which bears one or more of the wafer materials to be lapped as bonded to the lower surface thereof, is downwardly pressed against the turn table not directly by the top ring but it is pressed down by means of a rubber membrane under a pressure of a pressurized fluid or a hydraulic pressure. When the pressure of the fluid or air, with which the rubber membrane is pressed against the pressing plate, is regulated adequately by means of a pressure regulating means, the pressing plate is almost completely freed from the undesirable phenomenon of warping so that the wafer materials lapped with the lapping machine have flatness of the lapped surfaces and parallelism between the lapped surfaces of a wafer with an extremely high accuracy and precision.

In the following, a preferable embodiment of the method and apparatus of the invention is described in more detail with reference to the accompanying drawing.

Figure 5:
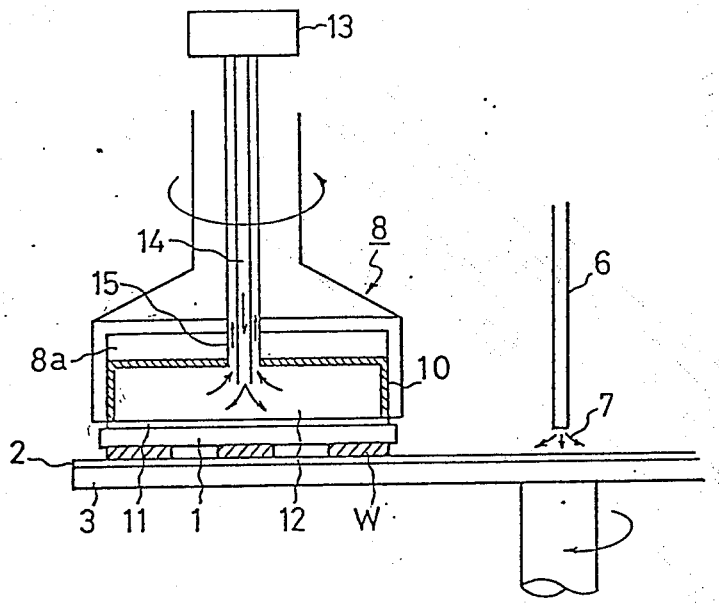
FIG. 5 is a schematic illustration of a lapping machine of the invention showing the principle of the inventive method.
Figure 6A:
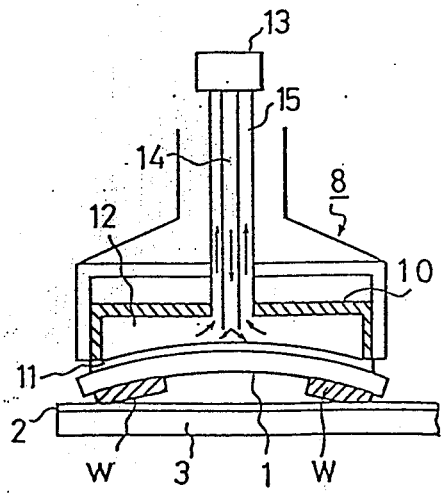
FIGS. 6*a* and 6*b* are each a schematic illustration of warping of the pressing plate in the inventive lapping machine when pressure of the compressed air is inadequately regulated.
Figure 6B:
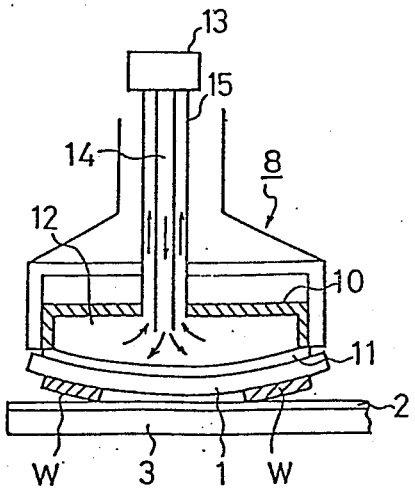

FIGS. 5, 6*a* and 6*b* schematically illustrate the principle of the inventive lapping machine. The lapping machine illustrated in FIG. 5 has a turn table 3 rotatable within a horizontal plane around the vertical axis as shown by the arrow and the upper surface of the turn table 3 is covered by a buffing cloth 2 spread and adhesively bonded to the surface. A top ring 8, which is also rotatable around a vertical axis, is hung down above the marginal zone of the turn table 3. The lower part of the top ring 8 is shaped in the form of a cup downwardly opening to have a cavity in which, though not essential, a pressure box 10 in the form of a downwardly opening dish with its face down is provided integrally with the top ring 8. A rubber membrane 11 is spread over and adhesively and fluid-tightly bonded to the periphery of the downwardly opening dish-like pressure box 10 so as to form a space 12 surrounded by the pressure box 10 and the rubber membrane 11. The space 12 is communicated to a fluid supply source with a fluid inlet tube 14 and a fluid outlet tube 15, preferably, in the form of a duplex tube through a pressure-regulating device 13.

The wafer materials W to be lapped are adhesively bonded to the lower surface of the pressing plate 1 and, before starting of the lapping machine, the pressing plate 1 bearing the wafer materials W is put on the turn table 3 so as to bring the surface of the wafer materials W into contact with the buffing cloth 2. Thereafter, the top ring 8 is lowered so that the rubber membrane 11 spread over the opening of the dish-like pressure box 10 is brought into contact with the upper surface of the pressing plate 1. The downward periphery of the pressure box 10, to which a rubber membrane 11 is fluid-tightly bonded over and to cover the the opening, is on the upper surface of the pressing plate 1 to transmit the load of the top ring 8 to the pressing plate 1. Compressed air is supplied to the space 12 surrounded by the rubber membrane 11 and the pressure box 10 through the fluid inlet tube 14 so that the pressure of the compressed air is transmitted to the upper surface of the pressing plate 1 through the rubber membrane 11 interposed between the pressurized space 12 and the plate 1. Rotation of the turn table 3 and the rotatable top ring 8 is started while an abrasive dispersion 7 is supplied to the buffing cloth 2 through the nozzle 6.

It is important here that the pressure of the compressed air in the space 12 is adequately regulated by means of the pressure-regulating device 13. When the pressure of the compressed air is lower than the pressure which the pressing plate 1 receives from the lower periphery of the pressure box 10, for example, warping of the pressing plate 1 may be caused to be high in the center portion as is illustrated in FIG. 6*a*. Accordingly, the surface of the wafers W is unavoidable lapped more in the outward portion below the marginal zone of the pressing plate 1 to decrease the parallelism of the surfaces. When the pressure of the compressed air is excessively high, on the other hand, the pressing plate is also warped to be low in the center portion as is illustrated in FIG. 6*b* so that the surface of the wafers W is unavoidably lapped more in the inward portion below the marginal zone of the pressing plate 1 also to decrease the parallelism of the surfaces. It is readily understood therefore that, when the pressure of the compressed air in the space 12 is adequately regulated by means of the pressure-regulating device 13, the pressing plate 1 takes an intermediate disposition between the warped states illustrated in FIGS. 6*a* and 6*b* without being warped both upwardly and downwardly to keep complete flatness thus to ensure a high degree of flatness of and parallelism between the surfaces of the lapped wafer materials. It is optional that the heat of friction produced by the proceeding lapping action is removed away by using a chilled abrasive dispersion 7 from the nozzle 6 at a low temperature or by providing another cooling means not illustrated in the figures.

Figure 7A:
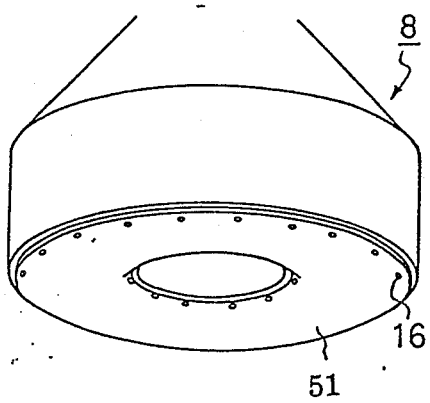
FIG. 7*a* is a perspective view of a top ring having an annular rubber membrane to cover the lower surface and FIG. 7*b* is a cross sectional view of such a top ring mounted on the turn table.
Figure 7B:
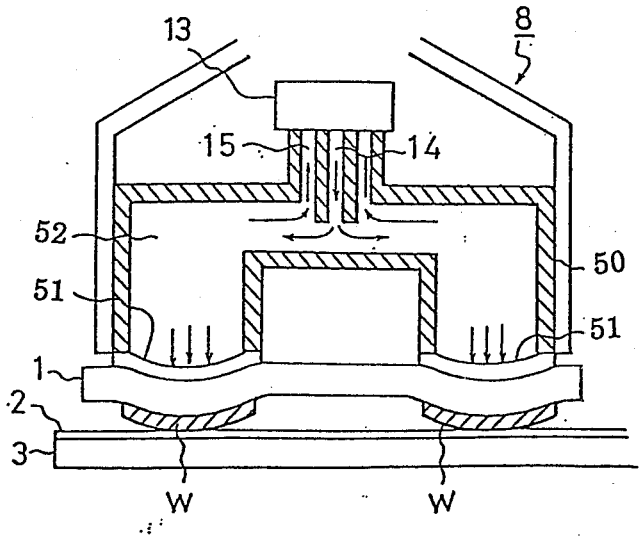

FIGS. 7*a* and 7*b* illustrate another embodiment of the inventive lapping machine, of which FIG. 7*a* is a perspective view of the top ring 8 showing the lower surface having a rubber membrane to face the pressure plate and FIG. 7*b* is a cross sectional view thereof. As is shown in FIG. 7*b*, the pressure box 50 has an outer side wall and inner side wall coaxially disposed to form a tubular space 52 and an annular rubber membrane 51 is spread only over the area between and air-tightly bonded to the lower peripheries of the outer and inner side walls of the pressure box 50. Though not limitative, the rubber membrane 51 is air-tightly bonded to the lower peripheries of the outer and inner side walls of the pressure box 50 by means of a plural number of screws 16 as is illustrated in FIG. 7*a*. Being provided with such a top ring 8 having an annular rubber membrane 51, the center portion of the pressing plate 1, where no wafers are bonded to the lower surface thereof, is free from the pressure of the compressed air, which otherwise is transmitted through the interposed rubber membrane, so that the pressing plate 1 is more completely freed from warping and a higher uniformity in the lapping effect can be obtained on the lapped surfaces of the wafers W.

Figure 8:
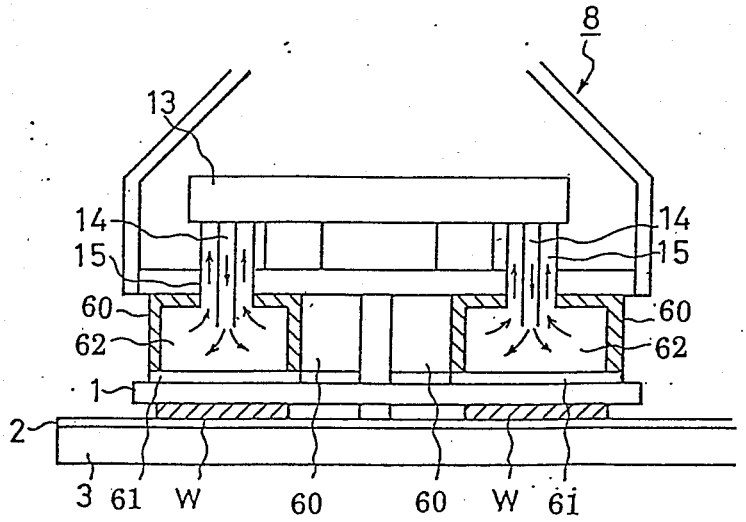
FIG. 8 is a schematic cross sectional view of a top ring of the inventive lapping machine, in which a plurality of pressure boxes are provided.

FIG. 8 illustrates a cross sectional view of a further different embodiment of the inventive apparatus showing the top ring having a plurality of pressure boxes and mounted on the turn table. Namely, there are provided a plural number of discrete pressure boxes 60, the number of which is the same as the number of the sites on the lower surface of the pressing plate 1 to which the wafer materials W are adhesively bonded. Corresponding, the rubber membrane is also divided into small membranes 61 each to be spread over and cover the lower opening of one of the pressure boxes 60 to form a pressurizable space 62 within each pressuer box 60. By this means, the pressure of the compressed air is transmitted to the pressing plate 1 through the rubber membrane 61 only on the very localized areas so that the precision in the lapping works can be further improved.

Figure 9:
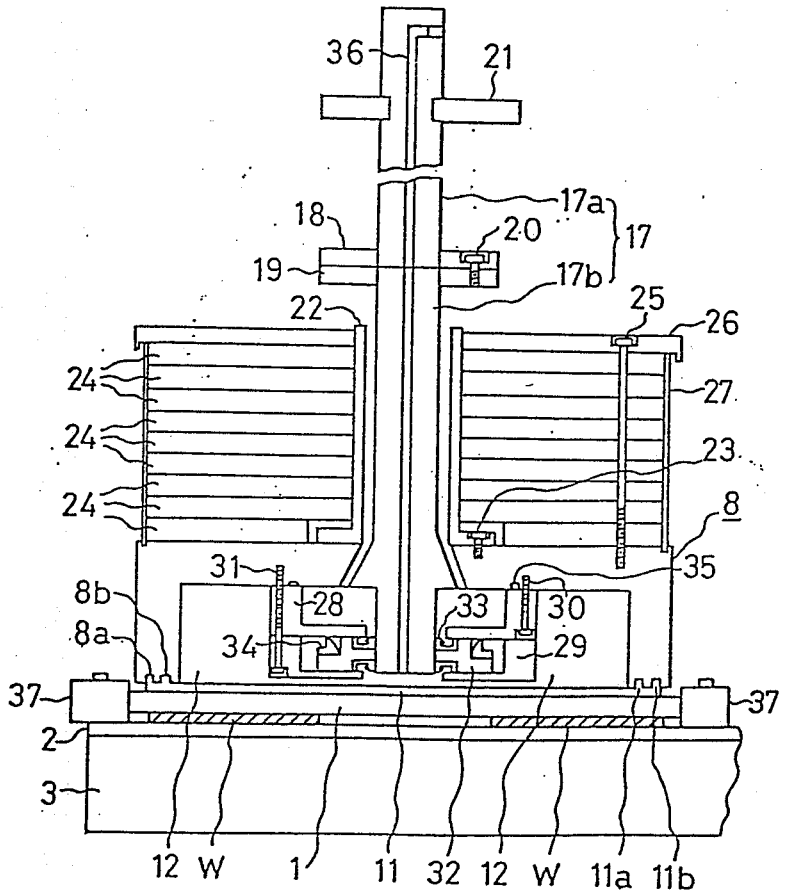
FIG. 9 is a shcematic cross sectional view of the actually designed inventive lapping machine as an example.
Figure 10:
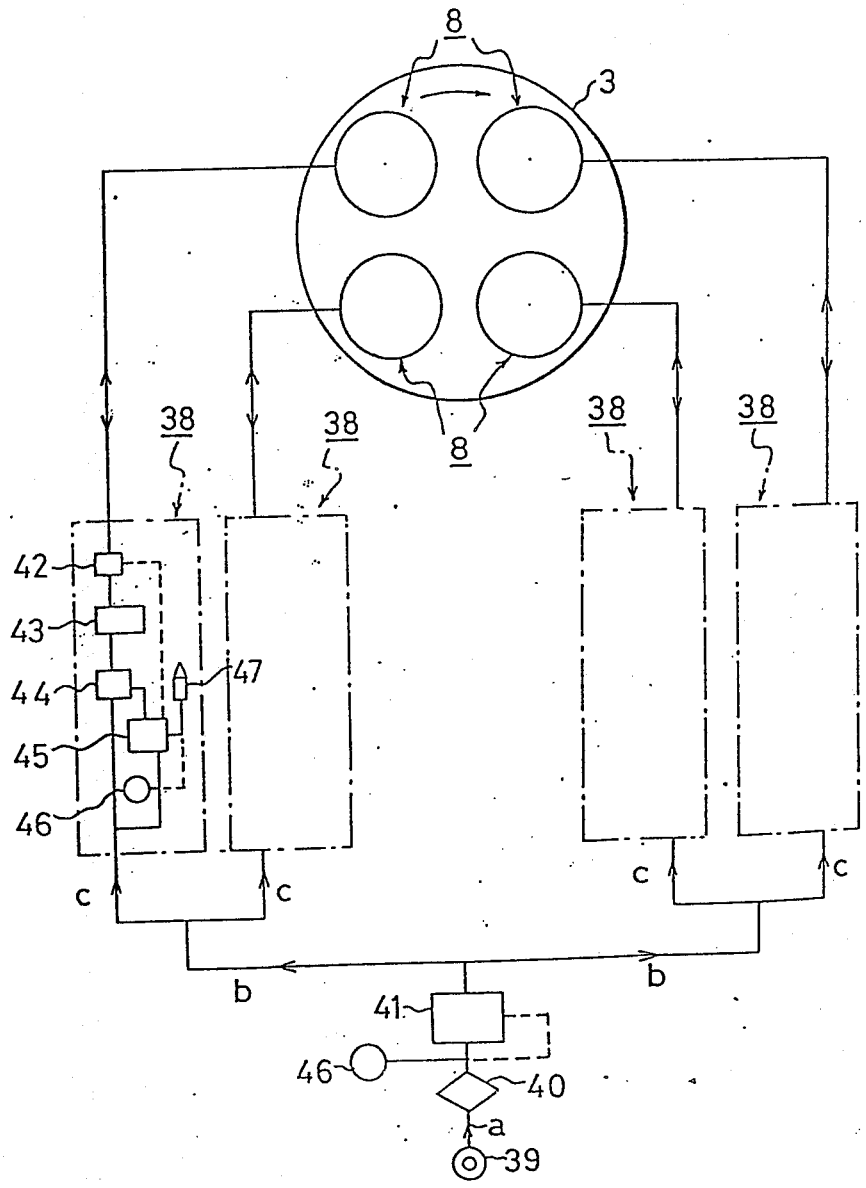
FIG. 10 is a block diagram showing the system for the pressure regulation of the compressed air with which the rubber membrane is pressurized.

Pursuant to the above given descriptive explanation of the principle of the improvement according to the invention, following is a more detailed description of the actual embodiment of the invention as an example with reference to FIGS. 9 and 10 of the accompanying drawing.

In FIG. 9, a circular turn table 3 is supported horizontally and rotated around a vertical axis by means of a driving system including an electric motor and a transmission (not shown in the figure) at a controlled velocity. The upper surface of the turn table 3 is covered with a buffing cloth 2 having an adequate elasticity spread over and bonded to the surface. Four, though not limitative to four, rods 17, of which only one is shown in the figure, are installed vertically each above the peripheral portion of the turn table 3. Each rod 17 is composed of the upper rod 17*a* and lower rod 17*b* integrally connected together by means of the flanges 18 and screw bolts 20. The rod 17 is movable up and down as being moved at the driving disc 21 connected to the upper rod 17*a* by means of a driving system (not shown in the figure). The lower portion of the rod 17 penetrates the center opening of a stainless steel-made top ring 8 in such a manner as to ensure free up-and down movement of the top ring 8 as being guided by the rod 17. The lower rod 17*b* is surrounded by a protecting pipe 22 which is fixed to the upper surface of the top ring 8 by means of screws 23. A plural number (nine in the figure) of lead-made plates each having a center opening are mounted on and integrally fixed by the screw bolts 25 to the top ring 8 with the protecting pipe 22 penetrating the center openings to serve as a weight. The stainless steel-made housing plates 26 and 27 cover the upper surface and the side surfaces, respectively, of the lead weights 24. A V-ring abutment 28 and a cap ring of slider 29 are connected to the lower surface of the top ring 8, the former being on the latter, by means of the screw bolts 30,31 to form a space therebetween which encloses a slider ring 32 in a freely slidable manner with the lower end of the lower rod 17*b* penetrating the ring slider 32. Upper and lower oil seals 33 are provided between the inner walls of the slider ring 32 and the lower end of the lower rod 17*b*. Further, a V-ring 34 is provided to surround the outer surface of the ring slider 32 to be in contact with the lower surface of the V-ring abutment 28. An O-ring 35 serves to keep air-tightness between the contacting surface of the V-ring abutment 28 and the lower surface of the top ring 8.

The downward opening of the top ring 8 is covered with a silicone rubber-made membrane 11 air-tightly connected to the lower periphery of the top ring 8. The air-tightness can be ensured by providing the lower periphery of the top ring 8 with two concentric ring grooves 8*a*, 8*b* which tightly fit to the two concentric ring ribs 11*a*, 11*b* formed on the marginal zone of the rubber membrane 11 which is under a spreading tension. In this manner, a space 12 is formed above the rubber membrane 11 air-tightly sealed excepting the opening at the lower end of the air supply duct 36 passing through the rod 17. Compressed air is introduced through the air supply duct 36 into the sealed space 12 under a pressure exactly regulated by means of the air-pressure regulating system of which the system diagram is illustrated in FIG. 10.

The pressing plate 1, which is pressed against the turn table 3 covered with a buffing cloth 2 by the rubber membrane 11 under a pressure of the compressed air in the closed space 12, is preferably made of a material having high rigidity such as a ceramic. A plural number (four in FIG. 9) of water materials W are bonded and fixed to the lower surface of the pressing plate 1 by using wax or the like material. The outer periphery of the pressing plate 1 is contacted with and guided by passively rotatable guide rollers 37 to be prevented from running away from the proper position below the top ring 8.

Following a description of the fluid-supply system 38 for supplying a pressurized fluid to the closed space 12 inside the top ring 8 with reference to FIG. 10. The turn table 3 is rotated in the direction shown by the arrow and a plural number (four in the figure) of top rings 8 are suspended above the turn table 3 at a symmetrical arrangement. Each top ring 8 is rotatable around the vertical axis. The lower portion of each top ring 8 is in the form of a downwardly opening cup covered by a rubber membrane to form a closed space as is described above. Compressed air is supplied to the closed space from an air-supply source 39 such as a compressor through the pipe line a including an air filter 40 and an air regulator 41. The pipe line a is divided into branches b and further into branches c, each of which is connected to the air inlet port 36 at the upper end of the rod 17 (see FIG. 9) via the pressure regulating system 38. The pressure regulating system 38 is composed of a booster relay 44, electromagnetic valve 43 and pressure sensor 42 and the booster relay 44 is provided with a precision controller 45, pressure gage 46 and silencer 47. The precision controller 45 acts to regulate the pressure of the compressed air supplied to the closed space of the top ring 8 in response to the electrical signals coming from the pressure sensor 42.

Following is a description of the lapping process by operating the above described lapping machine of the invention. The turn table 3 is driven to rotate around the center axis at a controlled velocity by a driving system (not shown in the figure). Each of the airsupply systems 38 is driven to supply compressed air under a regulated pressure to the closed space 12 surrounded by the rubber membrane 11 and the cup-like form of the top ring 8. Namely, the compressed air discharged from the compressor 39 flows along the pipe lines a, b and c through the air filter 40 and air regulator 41 and then introduced into the closed space 12 in the top ring 8 through the booster relay 44, electromagnetic valve 43 and rod 17 connected to the pipe line c at the air inlet port 36. The pressure $p_{air}$ of the compressed air introduced into the closed space 12, which is under regulation by the precision controller 45, should be correlated to the load G given by the weights 24 by the following equation $$G=P\times A'=p_{air}\times A,$$

in which G is the load given by the weights 24, P is the lapping pressure, A' is the area available for lapping, $p_{air}$ is the pressure of the compressed air and A is the contacting area between the rubber membrane 11 and the upper surface of the pressing plate 1. Assuming constancy of A' and A, $p_{air}$ is proportional to G so that $p_{air}$ should be controlled depending on the value of G.

In the embodiment illustrated in FIG. 9, an optimum value of the lapping pressure P is obtained by increasing or decreasing the number of the weights 24. This means is of course not limitative and control of the value of P can be obtained by other known means including the use of resilience of a spring and hydraulic pressure utilizing an air cylinder, oil cylinder and the like.

When the pressure $p_{air}$ of the compressed air is adequately regulated, the load on the pressing plate 1 is evenly distributed all over the upper surface of the pressing plate 1 to be freed from any slightest warping to keep complete flatness so that the lapping pressure P is uniformly distributed on all of the wafers W.

Figure 11:
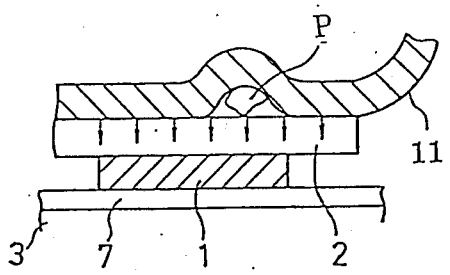
FIG. 11 is a schematic illustration of a dust particle entering between the rubber membrane and the upper surface of the pressing plate.

It is important that the top ring 8 loaded with the weights 24 and, consequently, the pressing plate 1 bearing the wafers W are rotated around the center rod 17 because otherwise the relative sliding velocity on the lapping surface of the wafers is varied from portion to portion along the radial direction of the turn table 3 due to the difference in the peripheral velocity of the rotating turn table 3 or the buffing cloth 2 spread on the turn table 3. By this rotation of the top ring 8, all of the wafers W are under a uniform lapping condition to be mirror-polished with the aid of a fine abrasive powder supplied from a nozzle (not shown in FIG. 9) in the form of a liquid dispersion. When a dust particle P enter between the rubber membrane 11 and the upper surface of the pressing plate 1 as is illustrated in FIG. 11, the adverse effect of this dust particle P is readily absorbed by the corresponding deformation of the rubber membrane 11 so that the results of lapping are little influenced thereby. By virtue of the elimination of any slightest warping of the pressing plate 1, the wafer materials W can be imparted with a very high degree of flatness of each lapped surface and parallelism between lapped surfaces so that the semi-conductor wafers lapped according to the invention are quite satisfactory in the manufacture of semiconductor devices under a requirement in recent years toward a higher and higher density of integration.

Figure 1:
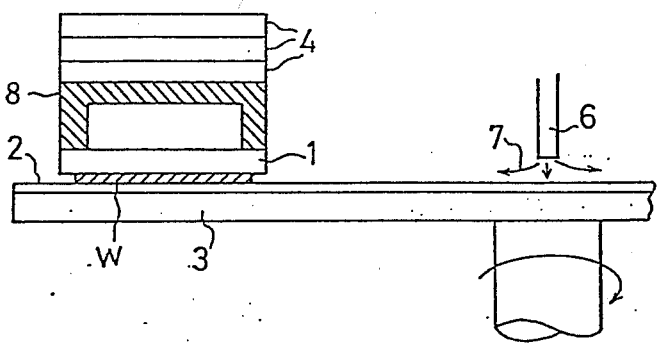
FIG. 1 PRIOR ART
FIGS. 1 and 2 are each a schematic illustration of a conventional lapping machine.
Figure 2:
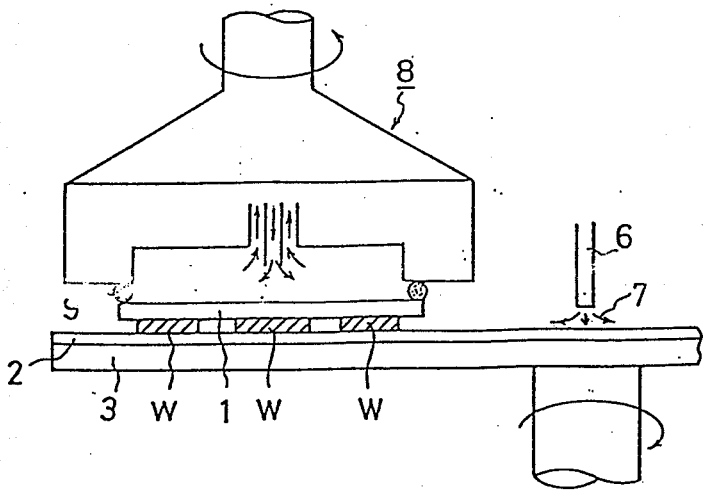
FIG. 2 PRIOR ART
Figure 3:
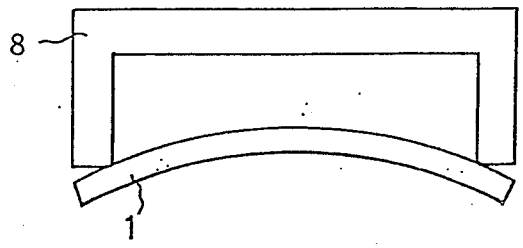
FIG. 3 PRIOR ART
FIGS. 3 and 4 each illustrate warping of the pressing plate in the lapping machines in FIGS. 1 and 2, respectively.
Figure 4:
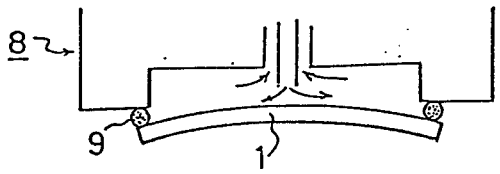
FIG. 4 PRIOR ART

A comparative lapping test was undertaken to show the flatness or variation in the thickness of the lapped wafers in μm obtained when semiconductor silicon wafers of 4 inches, 5 inches and 6 inches diameters were lapped using the lapping machines of the invention illustrated in FIGS. 5 and 7 and a conventional lapping machine illustrated in FIG. 2. The results, each being an average for 400 silicon wafers, were as tabulated below. It was found that the amount of lapping of the silicon wafers lapped on the machine of FIG. 2 was larger on the outward portions of the top ring than in the inward portion.

| Diameter of wafers,inches | Lapping machine of | | |
|---|---|---|---|
| | FIG. 5 | FIG. 9 | FIG. 2 |
| 4 | 5.2 μm | 2.0 μm | 7.1 μm |
| 5 | 6.1 μm | 2.4 μm | 7.8 μm |
| 6 | 8.3 μm | 2.7 μm | 10.4 μm |

In addition, it is a possible way according to the invention that the lapped surface of a wafer material is intentionally imparted with a non-flatness with either concavity or convexity depending on the intended application of the wafer material or to make a chamfered surface around each lapped surface.

Although the above given description is almost exclusively limited to the lapping works of semiconductor silicon wafers, it should be understood that the method and apparatus of the invention are applicable to the lapping works of any wafer-like materials such as glass plates and the like. Also, the pressurized fluid introduced into the closed space 12 of the top ring 8 is not limited to air used in the above described examples but may be water or any other fluid material. Use of water as a compressed fluid is particularly advantageous due to the cooling effect obtained by the water flowing in contact with the rubber membrane 11 to serve for the removal of the heat produced by abrasion.

Further, it is a possible modification that the top rings 8 are under a driving force to be compusorily rotated instead of the passive rotation in the above described lapping machines so that an advantage may be obtained that the velocity of lapping can be increased. It is of course optional that the rubber or, in particular, silicone rubber membrane 11, which serves to transmit the hydraulic pressure of the compressed fluid in the closed space 12 to the pressing plate 1, is replaced with a thin sheet of another material such as a metal, e.g., stainless steel, provided that the sheet may have a sufficient elasticity to transmit the pressure. The wafer materials can be bonded and fixed to the pressing plate by any known method including not only the method of using a wax described above but also the waxless method, vacuum-suction method and the like.

What is claimed is:

1. An apparatus for lapping a wafer material which comprises:

(a) a turn table horizontally rotatable around a vertical axis;

(b) a pressing plate, to the lower surface of which at least one wafer material is bonded, and mounted on the turn table to bring the wafer material into contact with the turn table;

(c) a top ring in the form of a downwardly opening cup, the opening thereof being covered by spreading a membrane of an elastic material fluid-tightly sealed to the periphery of the cup, rotatable around a vertical axis and mounted on the pressing plate to be in contact therewith by the mambrane of an elastic material;

(d) a means to supply a pressurized fluid to the space on the inner surface of the membrane of an elastic material; and (e) a means to regulate the pressure of the pressurized fluid.

* * * * *